United States Patent [19]

Eiden

[11] 4,218,059

[45] Aug. 19, 1980

[54] FIELD MARKER

[76] Inventor: Sidney W. Eiden, 103 Rockrose Dr., Meadowood, Newark, Del. 19711

[21] Appl. No.: 918,389

[22] Filed: Jun. 23, 1978

[51] Int. Cl.[3] ..... A63B 19/06

[52] U.S. Cl. ..... 273/25; 404/11; 272/3

[58] Field of Search ..... 273/25, 31; 404/6, 7, 404/9, 10, 11, 12; 297/461, 232, 462; 272/3, 100, 101; D 6/32; 52/103, 104

[56] References Cited

U.S. PATENT DOCUMENTS

| | | | |
|---|---|---|---|
| 1,797,498 | 3/1931 | Finley | 404/11 |
| 2,116,426 | 5/1938 | Cecil | 52/103 |
| 3,373,667 | 3/1968 | Taylor et al. | 404/12 |
| 3,682,476 | 8/1972 | Kempson | 272/100 |

FOREIGN PATENT DOCUMENTS

| | | | |
|---|---|---|---|
| 120745 | 12/1945 | Australia | 404/12 |
| 2450296 | 4/1976 | Fed. Rep. of Germany | 273/31 |
| 2228139 | 11/1974 | France | 404/12 |
| 261835 | 6/1926 | United Kingdom | 404/12 |
| 267688 | 3/1929 | United Kingdom | 404/12 |
| 418182 | 10/1934 | United Kingdom | 273/31 |

*Primary Examiner*—Richard C. Pinkham
*Assistant Examiner*—T. Brown
*Attorney, Agent, or Firm*—Connolly and Hutz

[57] ABSTRACT

A marker for delineating boundary and playing lines on an athletic field or the like comprises a hollow elongated keystone shaped body member having converging side walls and an open top face with a clearly colored cushioning member in the upper portion thereof and exposed at the top face so that the body member may be embedded in the ground with the cushioning member exposed at ground level.

1 Claim, 3 Drawing Figures

FIELD MARKER

BACKGROUND OF THE INVENTION

The present invention is directed to field markers and has particular utility for various types of athletic fields such as for playing football, baseball, soccer, track, tennis, etc. Conventionally, the boundary lines and the various playing lines within the field are delineated by forming lime lines upon the surface of the field. The use of such lining techniques has a number of disadvantages. For example, it is necessary to re-lime lines before each athletic contest and frequently re-liming is done during such contests. Traditionally, for example, in the 6th inning of a baseball game the grounds crew re-limes the foul lines where necessary. A further disadvantage with such temporary markings is that in inclement weather many of the markings become completely obliterated as commonly occurs during football games and because of the severe weather conditions no attempt is even made to re-lime the lines. Even when the weather is not inclement the markings frequently become destroyed in spots where players, for example, slide over the lime.

SUMMARY OF THE INVENTION

An object of this invention is to provide marking techniques which overcome the above disadvantages.

A further object of this invention is to provide a permanent means of marking a field and the invention has particular utility where the field is used for only one sport.

A still further object of this invention is to provide such a marker which is not affected by inclement weather or playing conditions.

In accordance with this invention a marker for delineating boundary and playing lines on an athletic field or the like comprises a hollow elongated keystone shaped body member having converging side walls and an open top face with a cushioning member in the upper portion thereof. The cushioning member is of a clearly visible color and is exposed at the top face so that the body member may be embedded in the ground with the cushioning member exposed at ground level.

Drain holes may be provided in the side walls and bottom wall of the body member so as to avoid any accumulation of water within the hollow body member.

In a preferred form of this invention a partition is formed across the side walls intermediate the open top face and the bottom wall of the body member for supporting the cushioning material. The cushioning material itself may be bowed away from the support partition in the central area longitudinally thereof to enhance its cushionability. Drain holes may also be provided in the partition along the central area.

THE DRAWINGS

DETAILED DESCRIPTION

Figure 1:
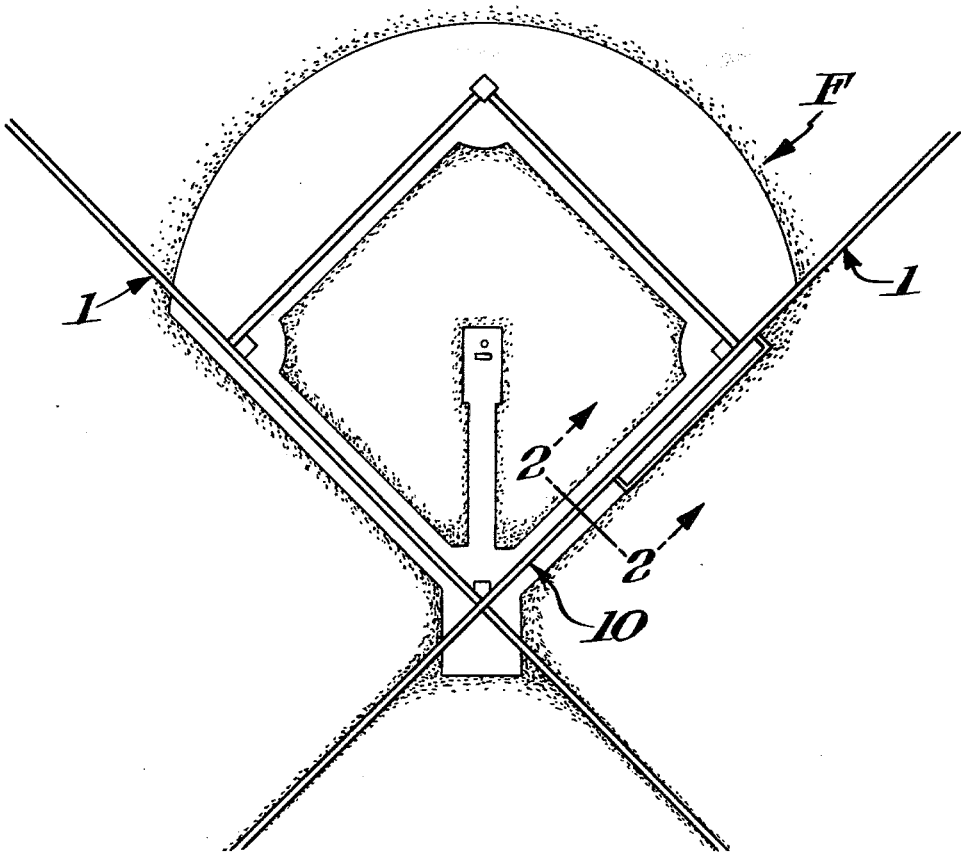
FIG. 1 is a plan view of an athletic field, more particularly a baseball diamond, incorporating the marker of this invention.

FIG. 1 illustrates a typical application of the invention. As indicated therein a baseball diamond F includes, for example, foul lines 1. Ordinarily, such foul lines are marked by liming. In FIG. 1, however, the foul lines are marked by the incorporation of the inventive markers 10. A similar application of such markers would be, for example, on a football field to delineate the use of boundary lines as well as the yardage lines each five yards.

As later described, markers 10 may be made of a durable material which will not deteriorate under normal conditions. The markers are embedded in the ground and thus function as permanent markers thereby avoiding the necessity of liming the field prior to each athletic event. The marking of the field may be accomplished by a single elongated marker, for example, for each line or in the preferable practice of the invention is accomplished by juxtaposing shorter lengths which in combination form a line.

Figure 2:
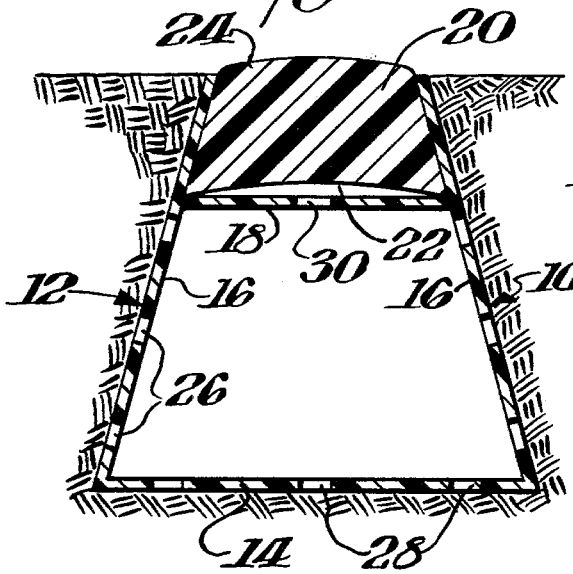
FIG. 2 is a cross-sectional view in elevation taken through FIG. 1 along the line 2—2.
Figure 3:
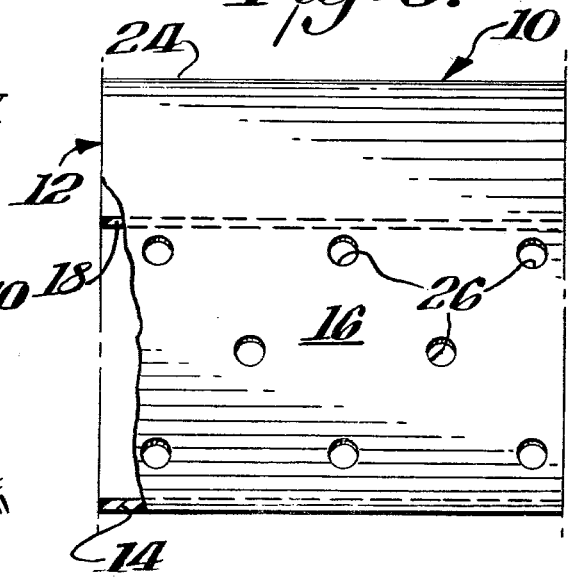
FIG. 3 is a side view in elevation partly broken away of a portion of the marker shown in FIG. 2.

FIGS. 2–3 illustrate the details of marker 10. As indicated therein markers 10 include a hollow elongated body member 12 which is keystoned shaped with a bottom wall 14 and converging side walls 16. A partition or support member 18 spans the sides at a location intermediate bottom wall 14 and the open top face of the body member. Cushioning means such as an elongated pad of material 20 is disposed in the upper portion of body member 12 and is supported by partition 18. Cushioning member 20 extends upwardly slightly beyond ends of side walls 16 or, if desired, may be flush therewith. As also shown in FIG. 2, cushioning member 20 is bowed away from support partition 18 in generally the central portion longitudinally of cushioning member 20 thereby creating a slight space between the lower surface 22 of cushioning member 20 and partition 18. This space enhances the cushionability of pad 20. The upper exposed surface 24 of cushioning member 20 is of clearly visible color since the exposed portion 24 functions as the visible line. In the preferred practice of this invention cushioning member 20 itself is made of the clearly visible color, such as a white color, so as to assure exposed surface 24 retaining that color. Because of its cushioning nature cushioning member 20 does not present any hazard to the participants. Thus, if stepped upon by a participant there is enough give to permit cushioning member 20 to move downwardly by compression and particularly toward the space between support 18 and lower surface 22 so as to offer the least resistance to a participant. Similarly, the cushionability of member 20 provides minimal interference with the grounds crew in, for example, mowing the grass along side marker 10.

In accordance with one ramification of this invention drainage holes are provided in the side walls 16 and bottom wall 14 of body member 12 as indicated by the reference numerals 26, 28, respectively. Thus, accumulation of water in the hollow interior of body member 12 is avoided. Similarly, partition 18 also includes drainage holes 30 for permitting any water thereupon to fall into the hollow interior of body member 12 and drain therethrough.

In a preferred form of this invention body member 12 is extruded from a suitable plastic such as Hypaton polyvinyl chloride or Alalkon polyethylene. Other suitable materials such as high density extruded polyethylene plastic may also be used. Such materials are readily available in any desired color at relatively low cost. Similarly, cushioning material 20 may be made of a suitable plastic or even a rubber material in the desired color. Cushioning pad 20 may likewise be extruded. The length of marker 10 may vary taking into account the intended end use, storage and transportation considerations, manufacturing techniques, etc. The lengths may be either full lengths or partial lengths of a size to be adapted for any particular use such as football or baseball fields. The lines may, of course, be customized by cutting a module at the desired location. Typical dimensions in the practice of this invention would be a vertical heighth of 5 inches with side walls 16 being $5\frac{3}{4}$ inches and the spacing between the side walls being 4 inches, while the width of bottom wall 16 to 6 inches. The various drain holes may, for example, be $\frac{3}{8}$ inches in diameter.

In practice of the invention a trench or elongated hole is dug of a width at least as wide as bottom wall 14 to permit marker 10 to be inserted therein. After the marker has been properly located so that side walls 16 terminate flush with the ground and exposed face 24 is slightly above the ground the hole is filled in so as the result in the condition in FIG. 2. The keystone shaped provides a permanent type mounting whereby marker 10 cannot be easily removed. If necessary, however, the marker can be removed for repair or replacement by digging away the triangular sections of dirt against the side walls 16.

As indicated above, marker 10 may be used for delineating boundary lines and/or playing lines on varous types of athletic fields. It should be understood, however, that the concepts of this invention are not limited to athletic fields but may be applied wherever there is a need for a delineation and particularly where a permanent delineation would be advantageous. Thus, for example, the concepts of this invention might be practiced for delineating runways in an airport. In this respect upper surface 24 instead of being white might be of a luminous or reflective color so as to be visible at night.

What is claimed is:

1. In an athletic field having a plurality of boundary and playing lines with the lines indicated by means of a plurality of visible markers, the improvement being each of said markers comprising a hollow elongated body member of substantially longer length than its width whereby an entire athletic field line is delineated by at least one of said markers, said body member being keystone shaped with a bottom wall and converging side walls extending upwardly away from said bottom wall, said body member being open at its top face with said side walls spaced from each other at said top face, a partition mounted within said body member spanning said side walls and dividing said body member into an upper portion and a lower portion, cushioning means in said upper portion of said body member disposed above and supported by said partition, said lower portion of said body member being a hollow chamber, said cushioning means being exposed at said top face, said cushioning means extending away from said bottom wall outwardly beyond said side walls at said top face, said cushioning means comprising an elongated pad of cushioning material, a plurality of drain holes being in said bottom wall and in said side walls below said cushioning means, further drain holes being in said partition below said cushioning means, said cushioning means having a clearly visible color on its surface exposed at said top wall whereby said body member may be mounted below the surface of a field with said exposed surface of said cushioning means disposed at at least ground level to thereby result in a line on the field delineated by said exposed surface of said cushioning means, said cushioning means being bowed upwardly transversely along its length thereof with the bottom surface of its central portion being spaced from said partition and with the longitudinal edges of said cushioning means being in contact with and resting on said partition, and said partition drain holes being in the general area of said central portion of said cushioning means where said cushioning means is bowed away from said partition.

* * * * *